United States Patent [19]

Cordani et al.

[11] Patent Number: 4,944,851

[45] Date of Patent: Jul. 31, 1990

[54] ELECTROLYTIC METHOD FOR REGENERATING TIN OR TIN-LEAD ALLOY STRIPPING COMPOSITIONS

[75] Inventors: John L. Cordani, Waterbury; Raymond A. Letize, West Haven, both of Conn.

[73] Assignee: MacDermid, Incorporated, Waterbury, Conn.

[21] Appl. No.: 361,548

[22] Filed: Jun. 5, 1989

[51] Int. Cl.[5] ..... C25C 1/12; C25C 1/14; C23F 1/44; C23F 1/46

[52] U.S. Cl. ..... 204/106; 204/115; 204/120; 204/130; 252/79.2; 252/79.4; 156/642; 156/656; 156/666; 134/3; 134/10; 134/41

[58] Field of Search ..... 204/105 R, 106, 114, 204/115, 120, 130; 252/79.2, 79.4; 134/3, 10, 41; 156/642, 656, 664, 666

[56] References Cited

U.S. PATENT DOCUMENTS

| | | | |
|---|---|---|---|
| 3,677,949 | 7/1972 | Brindisi et al. | 252/79.4 |
| 3,788,915 | 1/1974 | Gulla | 156/642 |
| 3,926,699 | 12/1975 | Dixon | 156/3 |
| 3,990,982 | 12/1976 | Dixon | 252/79.3 |
| 4,004,956 | 1/1977 | Brindisi | 156/666 |
| 4,297,257 | 10/1981 | Elias et al. | 260/29.6 H |
| 4,306,933 | 12/1981 | Da Fonte, Jr. | 156/644 |
| 4,374,744 | 2/1983 | Kawanabe et al. | 252/79.4 |
| 4,397,753 | 8/1983 | Czaja | 252/79.3 |
| 4,424,097 | 1/1984 | Lipka et al. | 156/656 |
| 4,439,338 | 3/1984 | Tomaiuolo et al. | 252/79.1 |
| 4,545,850 | 10/1985 | Nelson | 156/642 |
| 4,632,727 | 12/1986 | Nelson | 156/656 |
| 4,673,521 | 6/1987 | Sullivan et al. | 252/79.3 |
| 4,687,545 | 8/1987 | Williams et al. | 156/651 |
| 4,713,144 | 12/1987 | Schiller | 156/656 |
| 4,728,402 | 3/1988 | Prior | 204/109 |

FOREIGN PATENT DOCUMENTS 63-210292 8/1988 Japan .

*Primary Examiner*—John F. Niebling
*Assistant Examiner*—David G. Ryser
*Attorney, Agent, or Firm*—St. Onge Steward Johnston & Reens

[57] ABSTRACT

An aqueous solution of alkane sulfonic acid and inorganic nitrate used to strip metals from substrate surfaces, such as in stripping tin or tin-lead from copper surfaces, is regenerated by subjecting it to electrolysis to case dissolved stripped metals therein to deposit in metallic form on the surfaces of a cathode.

14 Claims, 1 Drawing Sheet

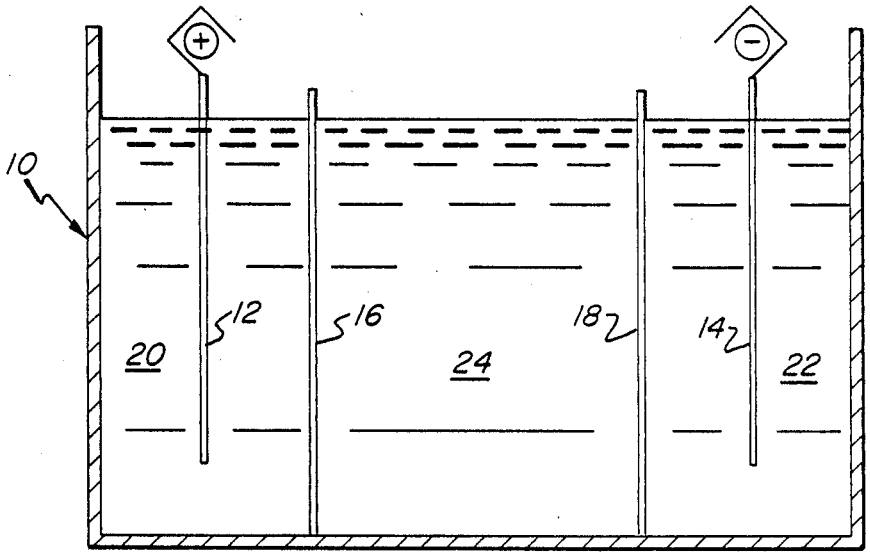
10
12
16
18
14
20
24
22

ELECTROLYTIC METHOD FOR REGENERATING TIN OR TIN-LEAD ALLOY STRIPPING COMPOSITIONS

BACKGROUND OF THE INVENTION

The present invention relates to the stripping of tin or tin-lead alloy layers from substrate surfaces, and more particularly to a method for regenerating tin or tin-lead alloy stripping compositions.

In the course of manufacturing printed circuit boards, it is commonplace to deposit (e.g., by electroplating, immersion or other like processes) a layer of tin or tin-lead alloy (solder) on all or selected conductive copper surfaces of the board defining traces, through-holes, surrounding pad areas and the like, to serve, for example, as an etch resist in the subsequent etching away of other copper surfaces. By the same token, it is necessary to eventually strip the tin or tin-lead alloy from all or selected copper surfaces coated therewith, as is needed for example when it is desired to plate certain copper surfaces (e.g., contact fingers) with nickel and/or gold to improve conductivity, or when it is desired to apply a solder mask over bare copper surfaces (SMOBC processes), or when it may be necessary simply to treat a reject piece in an effort to recover and re-use the underlying copper material. Also, while particularly apropos of printed circuit board manufacture, the need to strip away tin or tin-lead layers from copper surfaces also arises in other contexts where tin or tin-lead has been applied over a copper surface for decorative and/or functional purposes. Still further, needs may arise for stripping tin or tin-lead alloy layers from substrate surfaces other than copper, be they metallic or non-metallic surfaces.

Aqueous compositions designed to strip tin and/or tin-lead coatings from substrate surfaces, particularly copper surfaces, are known in the art. One class of such compositions includes those based upon hydrogen peroxide and hydrofluoric acid or a fluoride. See, e.g., U.S. Pat. Nos. 3,926,699; 3,990,982; 4,297,257; 4,306,933; 4,374,744 and 4,673,521. Another class involves those employing nitro-substituted aromatic compounds as a principal ingredient, often in conjunction with an inorganic acid (see, e.g., U.S. Pat. Nos. 3,677,949; 4,004,956; and 4,397,753) or an organic acid (see U.S. Pat. No. 4,439,338 disclosing the use of alkylsulfonic acids). Other known stripper compositions and processes are described in U.S. Pat. Nos. 4,424,097 and 4,687,545. Nitric acid-based strippers also have long been used in the art. See, e.g., the discussion in U.S. Pat. No. 4,713,144, and the use therein of a composition of nitric acid, sulfamic acid and ferric nitrate.

Irrespective of the particular type of stripping composition employed for removing tin or tin-lead alloy layers from a substrate, at some point the aqueous composition will undergo a decrease in its stripping effectiveness as stripped tin and/or lead species accumulate therein. The composition at that point can be discarded as waste, provided of course that suitable waste treatment methods are employed to insure that environmentally disadvantageous components are first removed and/or converted into environmentally acceptable form. More advantageous still would be to regenerate the aqueous composition so as to restore its stripping effectiveness. This is particularly attractive to those users of the aqueous stripping compositions who might not have adequate waste treatment systems on the premises since it would eliminate their need to arrange for hauling of potentially hazardous materials.

Regeneration as such can be quite complicated. For example, in ammonium bifluoride-hydrogen peroxide stripping compositions for tin or tin-lead, the aqueous composition can be regenerated (more accurately, replenished) by periodic additions of hydrogen peroxide to maintain its concentration above particular set levels required for effective stripping. Replenishment in this manner cannot, however, be effected indefinitely since eventually tin and/or lead and/or other complex metallic species build up to a degree which requires removal before stripping can continue effectively. Here again, the safe removal/disposal of these impurities is often not an easy matter, and, indeed, it would be far more economical if the metal values could somehow be easily recovered in saleable form.

A discussion of replenishment/regeneration of fluorine-containing solder stripping solutions (e.g., hydrogen peroxide-ammonium bifluoride-type baths) can be found in U.S. Pat. No. 4,673,521. The regeneration taught there involves addition of potassium ions to the solution to form a solid potassium-tin compound which can be separated from the solution. More particularly, the regeneration process involves filtering to remove sludge, addition of lime to separate lead, addition of potassium ions, filtering to remove the precipitated tin-potassium compound, passage through a chelating ion exchange resin ($H^+$ form) to remove copper ions, and then replenishment with additions of ammonium bifluoride and hydrogen peroxide to desired concentrations. The process is, thus, quite time consuming and still results in complex metal compounds which require further treatment.

SUMMARY OF THE INVENTION

It is an object of this invention to provide a process for regenerating a tin or tin-lead stripping composition to restore and/or maintain its stripping effectiveness while directly recovering metal values therefrom in metallic form.

According to the invention, a tin or tin-lead aqueous stripping composition comprised of an aqueous solution containing an alkane sulfonic acid and an inorganic nitrate is electrolytically processed to recover therefrom, in their metallic form, tin and/or lead. In so doing, the aqueous stripping composition is regenerated to (or maintained at) a high level of stripping effectiveness, requiring only replenishment of inorganic nitrate as may be needed to achieve or maintain a desired concentration thereof.

The foregoing alkane sulfonic acid/inorganic nitrate aqueous stripping composition is particularly effective in stripping tin or tin-lead from copper surfaces, including the tin-copper intermetallic which generally forms at the copper and the tin (or tin-lead) interface. The regeneration method of the present invention equally effectively removes copper from the solution in its metallic form.

In the aqueous alkane sulfonic acid/inorganic nitrate stripping composition employed in this invention, the inorganic nitrate generally serves to act upon the tin or tin-lead layer (and any tin-metal intermetallic layer such as tin-copper) to effect its removal from the substrate, while the alkane sulfonic acid generally serves the function of forming highly water-soluble salts of the removed metals. As such, under typical operating conditions, including substantial long-term use, the solution remains essentially sludge-free. As a consequence, the process of the present invention affords a means for direct regeneration without need for prior removal of insoluble metal compounds. Still further, the alkane sulfonic acid has the capability of solubilizing and maintaining tin in its $Sn^{+2}$ valence state. As a consequence, electrolytic treatment of the solution is capable of removing tin in its metallic form, i.e., by reduction at the cathode of the $Sn^{+2}$ species.

By removing tin and/or lead and/or other metals such as copper from the solution, the alkane sulfonic acid is restored to the form in which it can again serve to solubilize additional stripped metal. As needed, inorganic nitrate can then be added to restore the solution to full operating effectiveness.

As earlier noted, the electrolytic treatment of an alkane sulfonic acid/inorganic nitrate aqueous stripping solution according to the invention can be employed to regenerate the stripping solution at a point when the solution has lost, or suffered a significant decrease in, its ability to strip tin or tin-lead deposits from substrates. Alternatively, and as used herein still considered a form of regeneration, the process can be employed as a means for generally maintaining the stripping effectiveness of the solution by periodically or continuously removing tin and/or lead and/or other metal species therefrom.

In the electrolytic process, suitable anode and cathode elements are immersed in the solution and current applied at a suitable current density, e.g., from about 5 to about 250 amperes per square foot (cathode surface). At the cathode, the ionic species of the dissolved metals (e.g., tin and/or lead and/or copper) are reduced to their metallic (zero valence) state and deposit in that form onto the cathode surface.

In preferred embodiments of the invention, the anode element is isolated from the stripping solution, as by a suitable membrane or diaphragm, as a means for substantially minimizing oxidation at the anode of $Sn^{+2}$ to $Sn^{+4}$. Particularly in embodiments of the invention wherein the stripping solution is electrolytically treated while still having substantial stripping capability, it also is preferred to similarly isolate the cathode element from active stripping components of the stripping solution, also, e.g., as by a suitable membrane or diaphragm, so as to substantially minimize stripping of metals electrolytically deposited on the cathode surfaces. In either such embodiment, the isolated anode and/or cathode compartments are provided with a suitable concentration of alkane sulfonic acid.

The foregoing features and advantages of the invention are further described with reference to the drawing and the detailed description which follows.

BRIEF DESCRIPTION OF THE DRAWINGS

The FIGURE is a schematic sectional illustration of the interior of a vessel in which an alkane sulfonic acid-/inorganic nitrate stripping solution is electrolytically treated to remove stripped metal therefrom and thus regenerate the stripping solution.

DETAILED DESCRIPTION OF THE INVENTION

The stripping composition to which the present invention is applicable is an aqueous solution containing an alkane sulfonic acid and an inorganic nitrate as its essential components, although various other additives may also be present. The stripping composition is particularly designed to strip tin or tin-lead (solder) deposits, and still more particularly designed to strip tin or tin-lead deposits from copper metal substrates, including the stripping therefrom of tin-copper alloy or intermetallic which typically forms at the interface between the copper substrate and the tin or tin-lead layer. Strictly speaking, the electrolytic regeneration according to the present invention is not dependent upon whether the stripping solution was used to strip tin or tin-lead from any particular substrate surface, nor indeed whether the solution was used to strip tin or tin-lead. Thus, the invention is broadly applicable to the treatment of an alkane sulfonic acid/inorganic nitrate stripping solution containing therein dissolved salts of metals stripped by the solution, so long as the metal of such salts is in an ionic form permitting electrolytic reduction to the metallic state at the cathode. Without question, however, the electrolytic process of the present invention is primarily applicable to an alkane sulfonic acid/inorganic nitrate solution which has been used to strip tin or tin-lead, particularly from copper surfaces, since in such situations there is little if any sludge present in the solution, and the stripped metals are solubilized by the stripping solution in forms (i.e., $Pb^{+2}$, $Sn^{+2}$, $Cu^{+2}$) which permits of their reduction electrolytically to the metallic state at the cathode. For further description of the process of the present invention, this particular use of the stripping solution is presupposed unless otherwise indicated.

The alkane sulfonic acid in the stripping solutions processable according to the present invention is selected from any one or more compounds having the formula $RSO_3H$, where R is a lower alkyl group having from 1 to 5 carbon atoms, and preferably 1 or 2 carbon atoms, i.e., methane sulfonic acid or ethane sulfonic acid, with methane sulfonic acid most preferred.

The amount of alkane sulfonic acid employed in the aqueous compositions processable according to the invention in part depends upon the thickness of tin or tin-lead deposit being removed and the particular alkane sulfonic acid employed. Generally, however, and particularly for methane sulfonic acid, this component generally is present in the aqueous composition in an amount ranging from 1 to 100% by volume, more typically 10 to 50% by volume, and most typically 10 to 30% by volume, based upon a 70% methane sulfonic acid aqueous solution, which is a form in which methane sulfonic acid commonly is sold. Obviously, however, other concentrations, including the anhydrous form of the acid, can be used in making up the composition, and the above-stated ranges for the 70% concentration can be readily converted to ranges for other concentrations. Stated in terms of grams of anhydrous alkane sulfonic acid per liter of the overall stripper composition, the concentrations generally will be from about 10 to about 1500 g/l, more typically from about 95 to about 470 g/l, and most typically from about 95 to about 285 g/l.

The other essential ingredient of the aqueous stripper composition processed according to the present invention is an inorganic nitrate, such terminology being used herein to include nitric acid. Typically such inorganic nitrates are nitric acid, ferric nitrate, and the like, which are used alone or in admixture in the aqueous composition. Ferric nitrate is preferred in this regard, and is available commercially in a variety of concentrated aqueous solutions (e.g., 45% anhydrous ferric nitrate) or as hydrated crystals. Typically, the amount of ferric nitrate employed in the stripper composition is expressed in terms of anhydrous ferric nitrate, and generally ranges from about 1 g/l up to saturation in the composition, more typically from about 3 g/l to about 150 g/l and most typically from about 30 g/l to about 60 g/l. Generally speaking, these same ranges are employed for other inorganic nitrates, including nitric acid.

The aqueous stripping composition often will contain, in addition to water, only two ingredients, i.e., a single alkane sulfonic acid and a single inorganic nitrate, and most typically the ingredients will be methane sulfonic acid and ferric nitrate. Other components can, however, be present, and the efficacy of the electrolytic process herein in regenerating the solution is generally unaffected by the presence of such other additives.

The stripping process will involve either immersion of the substrate to be stripped in the aqueous stripping composition, or spraying of the solution onto the substrate surfaces. Typically, the stripping will be effected at a solution temperature of from about 100° F. to about 150° F., but room temperature operation also is possible.

As noted at the outset, the stripping solution obviously becomes increasingly spent as it performs its stripping function, and as a consequence becomes progressively less capable of effecting stripping, at least in commercially economic treatment times. To the extent the decrease in effectiveness is attributable to consumption of the inorganic nitrate, it is of course possible to add fresh nitrate to reestablish or maintain operationally effective concentrations thereof in the solution. However, loss of effectiveness is also associated with "consumption" of the alkane sulfonic acid (i.e., by virtue of having formed soluble salts with the stripped metal species); the solution becomes increasingly less capable of solubilizing the stripped metals, with the consequence of decreased stripping rate and/or redeposition of metal onto the substrate and/or potential formation of precipitate in the solution. Additional alkane sulfonic acid can of course be added to replenish this component, but even then it will eventually be necessary to to remove a corresponding portion of the stripping solution. The present invention affords a means for regenerating the bath per se or any removed portion thereof both to recover metal values and to reestablish operating concentrations of the alkane sulfonic acid.

In the process of the present invention, the stripping solution can be treated in its entirety in the immersion vessel in which it is employed, or in the collection vessel associated with a spraying operation, by immersion therein of anode and cathode elements and application of the requisite current. More typically, the solution will be drawn off to a separate vessel having prearranged anode and cathode elements and, where employed, prearranged means for isolating the anode and/or cathode from the stripping solution, the solution being fed to the appropriate compartment defined by the isolation means. All or a portion of the stripping solution from the immersion or collection vessel can be drawn off to the electrolysis tank for regeneration in this method. Still further, the process can be operated as either a batch or continuous process.

In the electrolytic treatment, the anode element can be composed of any of the conventionally employed anode materials, such as carbon, stainless steel, platinized titanium, rare metal (e.g., ruthenium, iridium) oxide coated titanium, and the like, with platinized titanium preferred. The cathode element also is composed of conventional materials upon which metallic forms of the dissolved metal species in the stripping solution can be plated (and most preferably in a form which is commercially saleable or of other economic value), such as copper, stainless steel, tin or the like, preferably copper metal sheet. The anode and cathode are connected by appropriate cables to the positive and negative terminals, respectively, of an appropriate rectifier, and a potential applied to produce a current density of from about 5 to 250 ASF, more preferably from about 20 to about 100 ASF, based on the cathode surface area.

Although the anode and cathode elements can be in direct contact with the stripping solution being treated, it is preferred that, at a minimum, the anode element be isolated from the solution, particularly where the stripping solution contains dissolved $Sn^{+2}$ salts as will be the case when the solution was employed to strip tin or tin-lead layers, and indeed it is a significant advantage of the alkane sulfonic acid/inorganic nitrate stripping solution that it solubilizes stripped tin in the $Sn^{+2}$ form. In the absence of such isolation, the reactions at the anode may result in oxidation of $Sn^{+2}$ to $Sn^{+4}$, in which form it cannot be effectively reduced to the metallic state and plated onto the cathode element.

The isolation of the anode element is accomplished by arrangement of a suitable porous barrier element between the anode element and the stripping solution to be regenerated, thus forming an anode compartment on one side of the barrier containing the anode element and into which is added a suitable concentration of an alkane sulfonic acid (most preferably the same acid as that employed in the stripping solution itself). By reason of the porous barrier and the acid concentration in the anode compartment, the opportunity for the stripping solution containing the dissolved metal salts to enter into the anode compartment is substantially minimized simply from a physical/fluid transfer point of view; under electrolytic operating conditions, of course, the potential gradient across the cell will be such as to further minimize the possibility of the metallic ions migrating to the anode rather than to the cathode.

As such, the barrier element used to define the separate anode compartment can be chosen from any suitable porous physical barrier material, such as a diaphragm or a porous ceramic, which is compatible with, and maintains its integrity in, the acidic solutions in which it will be in contact, or a suitable membrane having ion-selectivity such that it is capable of preventing the metal ions of the electrolyzed stripping solution from crossing into the anode compartment (such as the Nafion® membranes available from E. I. duPont deNemours & Co.). In either case, the barrier element can completely envelop the anode element (e.g., as in a porous ceramic pot) or simply be arranged in planar form across the vessel such that it forms, with portions of the vessel walls, a separate anode compartment.

It may also be necessary or desirable to achieve a similar isolation of the cathode element from the stripping solution being treated. This need or desirability is dependent upon the degree to which the solution remains an effective stripper during the course of regeneration, which in turn is largely dependent upon the concentration of inorganic nitrate. In situations where the regeneration process is conducted batch-wise, the stripping solution being electrolyzed is typically of sufficiently low inorganic nitrate concentration as to eliminate any substantial risk that the solution will strip the deposited metals from the cathode surface (for this same reason, any replenishment of inorganic nitrate is preferably conducted only after the electrolytic treatment). For processes conducted on a continuous or semi-continuous basis, however, the stripping solution may indeed have sufficient retained stripping effectiveness to strip metals deposited on the cathode surfaces. Accordingly, in those situations it is greatly preferred to utilize a porous barrier element between the cathode element and the stripping solution to be regenerated, and which thus serves to define a separate cathode compartment containing the cathode element and an added suitable concentration of an alkane sulfonic acid. Functionally, the porous barrier is such as to permit passage therethrough into the cathode compartment of the dissolved metal ions to be reduced at the cathode while resisting passage into the cathode compartment of anionic species, such as the nitrate moiety, which might otherwise lead to the presence in the cathode compartment of a sufficiently active stripping solution which will interfere with deposition of reduced metals on the cathode surface. To this end, cation-specific membranes, such as the earlier-noted Nafion® types, are preferred. As with the anode barrier, the porous barrier for the cathode can envelop the cathode or be arranged in planar form so as to form with portions of the walls of the vessel a separate cathode compartment.

Referring to the FIGURE, there is shown a vessel 10 in which the electrolytic process is conducted, employing anode element 12 and cathode element 14 (connections to rectifier not shown). Ion-selective membranes 16 and 18 (which may be the same or different materials) are shown in planar arrangement and serve to divide the vessel into anode compartment 20, cathode compartment 22 and stripping solution compartment 24. Alkane sulfonic acid is added to the anode and cathode compartments, and electrolysis results in deposition on the surfaces of cathode element 14 of the metals (e.g., tin, lead, copper) of the dissolved metal salts in the stripping solution, thereby recovering these metals in valuable form and regenerating alkane sulfonic acid in the stripping solution. After such treatment, the stripping solution is removed from vessel 10, and replenished as necessary with additional inorganic nitrate, preferably nitric acid, particularly if ferric nitrate is employed in the stripping solution, since the nitric acid will serve to oxidize ferrous ion (formed by reduction of ferric ion during the electrolytic process) back to ferric ion. The solution is then recycled back to the stripping operation (i.e., to an immersion tank or spray supply vessel) for further use.

As previously noted, among the many advantageous properties of the alkane sulfonic acid/inorganic nitrate stripping solution is the minimal formation of sludge therein, even after relatively long-term use in stripping tin or tin-lead. As a consequence, it generally will not be necessary to subject the solution to a filtration step to remove solids therefrom as part of the regeneration process, although such a step can of course be practiced if for some reason particulate matter is present.

Among the many advantages of the present invention is the provision of a process which can be utilized on-site by the ultimate user of the stripping solution, thereby avoiding his need either for elaborate waste treatment facilities or for having the solution transported to suitable off-site treatment location. Still further, the solution is regenerated and metals recovered therefrom without need for elaborate processes involving chemical additions to form precipitates, filtering, further chemical treatments, and the like, thereby greatly reducing the overall cost of the stripping process. The process is ideally suited for continuous or semi-continuous operation, enabling an inexpensive closed loop system wherein the stripping effectiveness of the stripping solution can be generally maintained at a high level without need for process interruptions. Also, of course, the metals are recovered (in metallic form on the cathode surfaces) in a form which not only greatly facilitates further handling but which also affords economic advantage.

The present invention is further illustrated with reference to the following example.

An aqueous solder stripping solution was prepared containing 180 g/l methane sulfonic acid and 40 g/l ferric nitrate. The solution was employed to strip 60/40 solder from a copper substrate for an extended period. Upon analysis, the solution contained 28.1 g/l tin, 18.0 g/l lead, 8.0 g/l iron and 7.0 ppm copper.

The solution was then subjected to electrolysis using a carbon anode surrounded by a porous ceramic pot and a copper cathode, at a current density of 50 ASF for one hour, with analysis of the solution after one-half hour and one hour, with the following results (in g/l except where noted):

| | ½ Hour | One Hour |
|---|---|---|
| Tin | 17.0 | 11.7 |
| Lead | 11.0 | 6.2 |
| Copper | 7.0 ppm | 6.0 ppm |
| Iron | 8.0 | 8.0 |

To complete the regeneration process, nitric acid was then added to the solution to again achieve a ferric nitrate concentration of about 40 g/l and the solution then employed to further strip solder from copper surfaces.

While the invention has been described with reference to particular embodiments and features, these have been presented as illustrative of the process and of the best known modes for carrying out the process, and are not intended as limitations on the invention as set forth in the appended claims.

What is claimed is:

1. A method for treating a metal stripping composition, initially comprised of an aqueous solution of an alkane sulfonic acid and ferric nitrate, and which by virtue of its use in stripping metals comprises of tin or tin-lead from a substrate surface, contains therein stripped metals comprised of tin and optionally lead in the form of solubilized metal salts, including soluble metal salts of said alkane sulfonic acid, comprising electrolyzing said aqueous solution utilizing an anode element and a cathode element under conditions of current density effective to deposit said stripped metals, in their metallic form, on the surfaces of said cathode element.

2. A method for regenerating a metal stripping composition, initially comprised of an aqueous solution of an alkane sulfonic acid and ferric nitrate and which, by virtue of its use in stripping metals comprises of tin or tin-lead from a substrate surface, contains therein metals comprised of tin and optionally lead, stripped by said composition, in the form of solubilized metal salts, including soluble metal salts of said alkane sulfonic acid, comprising electrolyzing said aqueous solution utilizing an anode element and a cathode element under conditions of current density effective to deposit said stripped metals, in their metallic form, on the surfaces of said cathode element, so as to decrease the dissolved stripped metal content of said solution and increase the concentration therein of free alkane sulfonic acid.

3. The method according to claim 2 further comprising adding to said solution, after said electrolyzing, an inorganic nitrate in an amount sufficient to return the concentration of said ferric nitrate in the aqueous solution to substantially that of the initial aqueous metal stripping solution.

4. A method for treating a metal stripping composition, initially comprised of an aqueous solution of an alkane sulfonic acid and ferric nitrate, and which, by virtue of its use in stripping tin or tin-lead from a copper substrate surface, contains therein tin, copper and optionally lead in the form of solubilized metal salts, including $Sn^{+2}$ salts of said alkane sulfonic acid, comprising electrolyzing said aqueous solution utilizing an anode element and a cathode element under conditions of current density effective to deposit tin, copper or lead, in metallic form, on the surfaces of said cathode element.

5. The method according to any of claims 1, 2 or 4 wherein, in said initial aqueous solution, said alkane sulfonic acid is present in an amount from about 10 to about 1500 g/l, and wherein said ferric nitrate is present in an amount of from about 1 g/l to saturation.

6. The method according to any of claims 1, 2 or 4 wherein said electrolyzing is carried out at a current density in the range of from about 5 to about 250 amperes per square foot.

7. The method according to any of claims 1, 2 or 4 wherein said anode element is isolated from said aqueous stripping solution during said electrolyzing so as to substantially minimize oxidation at said anode of dissolved stripped metals in said solution.

8. The method according to any of claims 1, 2 or 4 wherein, during said electrolyzing, said anode element is isolated from said aqueous stripping solution by means of a porous diaphragm or ion-selective membrane so as to substantially minimize oxidation at said anode of dissolved stripped metals in said solution.

9. The method according to any of claims 1, 2 or 4 wherein said cathode element is isolated from said aqueous stripping solution during said electrolyzing so as to substantially minimize stripping of the metals deposited on the surfaces of said cathode element.

10. The method according to any of claims 1, 2 or 4 wherein, during said electrolyzing, said cathode element is isolated from said aqueous stripping solution by means of a cation-specific membrane so as to substantially minimize stripping of the metals deposited on the surfaces of said cathode element.

11. The method according to any of claims 1, 2 or 4 wherein said treating or regenerating is carried out in a continuous mode.

12. The method according to any of claims 1, 2 or 4 wherein the surface of said cathode element is copper metal.

13. A method for regenerating a metal stripping composition, initially comprised of an aqueous solution of an alkane sulfonic acid and ferric nitrate in concentrations effective to strip tin or tin-lead from a copper substrate and to strip tin-copper alloy to the extent present on said copper substrate, and which, by virtue of its stripping of tin or tin-lead, contains reduced concentration of ferric nitrate, reduced concentration of free alkane sulfonic acid, and dissolved tin, copper and, optionally, lead salts, said method comprising drawing off at least a portion of said aqueous solution from the vessel in which it is contained and delivering it to an electrolytic cell containing anode and cathode elements, at least said anode element being isolated from said aqueous solution by a porous barrier element so as to form a separate anode compartment containing said anode element and alkane sulfonic acid, subjecting said solution to electrolysis under conditions of current density effective to cause dissolved tin, copper and, optionally lead to deposit on the surface of said cathode element in metallic form, thereby increasing the free alkane sulfonic acid concentration in said aqueous solution, removing at least a portion of said electrolyzed solution from said electrolytic cell, and thereafter adding thereto sufficient inorganic nitrate so as to increase the concentration of ferric nitrate in said solution to substantially that present in said initial aqueous stripping composition.

14. The method according to claim 13 wherein said electrolytic cell further comprises a cation-specific membrane serving to define a separate cathode compartment, containing said cathode element and alkane sulfonic acid, such that said cathode element is isolated from said aqueous stripping solution.

* * * * *